US006671923B2

(12) United States Patent
Gromnicki

(10) Patent No.: US 6,671,923 B2
(45) Date of Patent: Jan. 6, 2004

(54) MOP WRINGER

(76) Inventor: Martin F Gromnicki, 442 W. 17th Ave., Oshkosh, WI (US) 54902

( * ) Notice: Subject to any disclaimer, the term of this patent is extended or adjusted under 35 U.S.C. 154(b) by 97 days.

(21) Appl. No.: 10/073,603

(22) Filed: Feb. 11, 2002

(65) Prior Publication Data

US 2002/0073502 A1 Jun. 20, 2002

Related U.S. Application Data

(63) Continuation-in-part of application No. 09/513,986, filed on Feb. 26, 2000, now abandoned.
(60) Provisional application No. 60/126,560, filed on Mar. 26, 1999.

(51) Int. Cl.[7] ..... A47L 13/59
(52) U.S. Cl. ..... 15/261
(58) Field of Search ..... 15/261

(56) References Cited

U.S. PATENT DOCUMENTS 818,467 A * 4/1906 Putnam ..... 15/261
960,371 A * 6/1910 Monahan ..... 15/261
1,234,721 A * 7/1917 Boggess ..... 15/261

* cited by examiner

*Primary Examiner*—Mark Spisich
(74) *Attorney, Agent, or Firm*—Jon Carl Gealow

(57) ABSTRACT

A mop wringer having a pair of spaced frame members or lateral plates, each having a lower leg member, and includes structure for attaching the wringer to a receptacle. A stationary squeeze plate and a movable squeeze plate are located in the space between the frame members and between which the mop may be placed for wringing, the movable squeeze plate pivoting about a middle axle extending between the frame members. A foot pedal is pivotally connected to the lower leg members about a lower-most axle. An upper axle, disposed above the middle axle, extends through and between the frame members. One or more disks are mounted about the upper axle adjacent each of the frame members, the disk being connected to an upper portion of the movable squeeze plate by one or more connecting arms. Second connecting arms interconnect the foot pedal to the outside disks. A coiled steel spring, is operatively connected between the disks and the adjacent frame member and one of the connecting arms between the outside disk and the movable squeeze plate. When the user depresses the foot pedal, the movable squeeze plate is pivoted toward the stationary squeeze plate, and when released, the movable squeeze plate is returned to a rest position.

4 Claims, 5 Drawing Sheets

MOP WRINGER

This application is continuation-in-part of application Ser. No. 09/513,986 filed on Feb. 26, 2000, now abandoned, which claims the benefit of Provisional patent application Serial No. 60/126,560 filed Mar. 26, 1999.

FIELD OF THE INVENTION

This invention relates to custodial equipment utilized for wringing a wet mop. In its more specific aspect, this invention relates to a mop wringer such as used by a building custodian for wringing excess liquid from a mop.

BACKGROUND OF THE INVENTION AND PRIOR ART

Wet mop wringers in use or shown in the art use downward pressure and sideways pressure by the custodian, which require an unnatural posture when pressing on the pressure handle during wringing. These mop wringers also require that significant force be exerted on the palm of the hand when pressing on the pressure handle during wringing. The wringing motion, posture, and force required by downward and sideways wet mop wringers might place unnecessary stresses and strains on the hand, wrist, shoulder, back, and legs.

OBJECTS OF THE INVENTION

This invention has therefore as an object is to provide an ergonomical alternative to sideways pressure and downward pressure required for conventional mop wringers.

It is another object of the invention to provide a mop wringer designed to make it easier to wring wet mops, thus improving productivity and reducing force and posture factors as work-related musculoskeletal disorders.

It is yet another object of the invention to provide a mop wringer utilizing components made of or plastic material, such as high-density polyethylene, that will be mostly rigid but slightly flexible and readily fabricated as by suitable injection molding, and easily fabricated metal hardware used as connectors and cross members.

SUMMARY OF THE INVENTION

The mop wringer of my invention easily and effortlessly wrings excess liquid out of a mop. A foot pedal cooperative with connecting arms and disk links actuates a movable squeeze plate to wring excess liquid out of a wet mop. The operator need only step with one foot and moderate body weight on the foot pedal. Erect posture is maintained during the wringing process. The operator does not have to push, pull, or twist the mop handle during the wringing process.

This mop wringer is positioned on the rim of a bucket with its wringing basket over the bucket opening and uses opposed squeeze plates, one movable and the other stationary, to wring the mop. Foot pedal depression provides movement to the movable squeeze plate that wring excess liquid out of a wet mop.

The operator maintains an erect posture, uses body weight to depress the foot pedal, and has only to hold the wet mop handle upright during the wringing process. Bias means, e.g., return springs, allow the wringing basket to open for the next wringing step when the operator releases the foot pedal.

Broadly, the mop wringer comprises a pair of spaced frame members or lateral plates, each having a lower leg member, and includes means for attaching the wringer to a receptacle. A stationary squeeze plate and a movable squeeze plate are located in the space between the frame members between which the mop may be placed for wringing, the movable squeeze plate having a lower portion pivoting about a middle axle extending between the frame members. A foot pedal is pivotally connected to the lower leg members about a lower-most axle. An upper axle, disposed above the middle axle, extends through and between the frame members. One or more disks are mounted about the upper axle adjacent each of the frame members, the disk being connected to an upper portion of the movable squeeze plate by a connecting arm, desirably a pair of connecting arms. Second connecting arms interconnect the foot pedal to the disks. Bias means, e.g. coiled steel spring, is operatively connected between the disks and the adjacent frame member and one of the connecting arms between the disk and the movable squeeze plate. When the user depresses the foot pedal, the movable squeeze plate is pivoted toward the stationary squeeze plate, and when the user releases the foot pedal, the movable squeeze plate is returned to a rest position by the bias means.

BRIEF DESCRIPTION OF THE DRAWINGS

The invention and its advantages will be more readily understood by reference to the following detailed description and exemplary embodiments when read in conjunction with the following drawings, wherein.

DETAILED DESCRIPTION OF INVENTION

Figure 1:
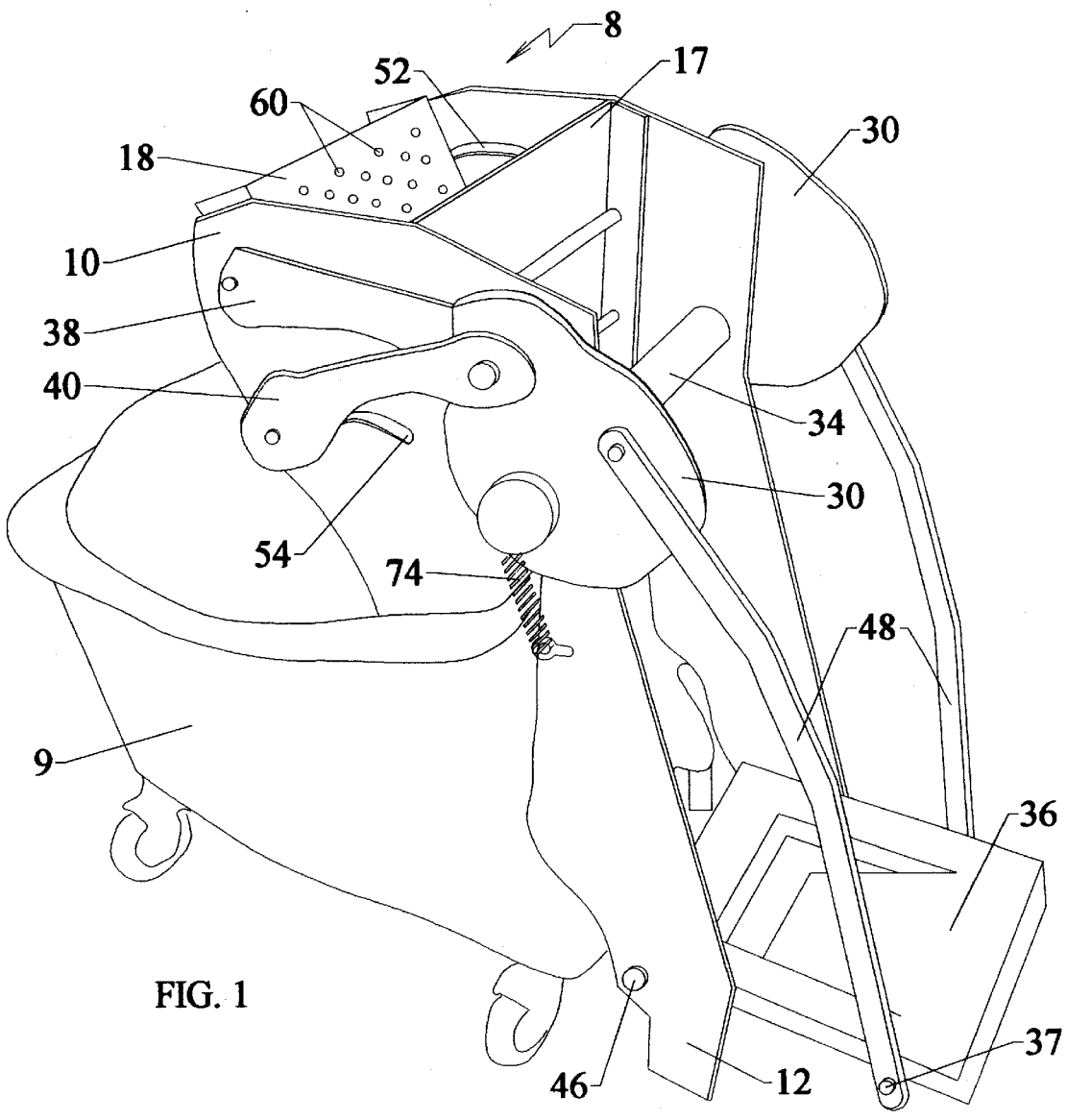
FIG. 1 is a perspective view of the mop wringer as positioned in a mop bucket
Figure 2:
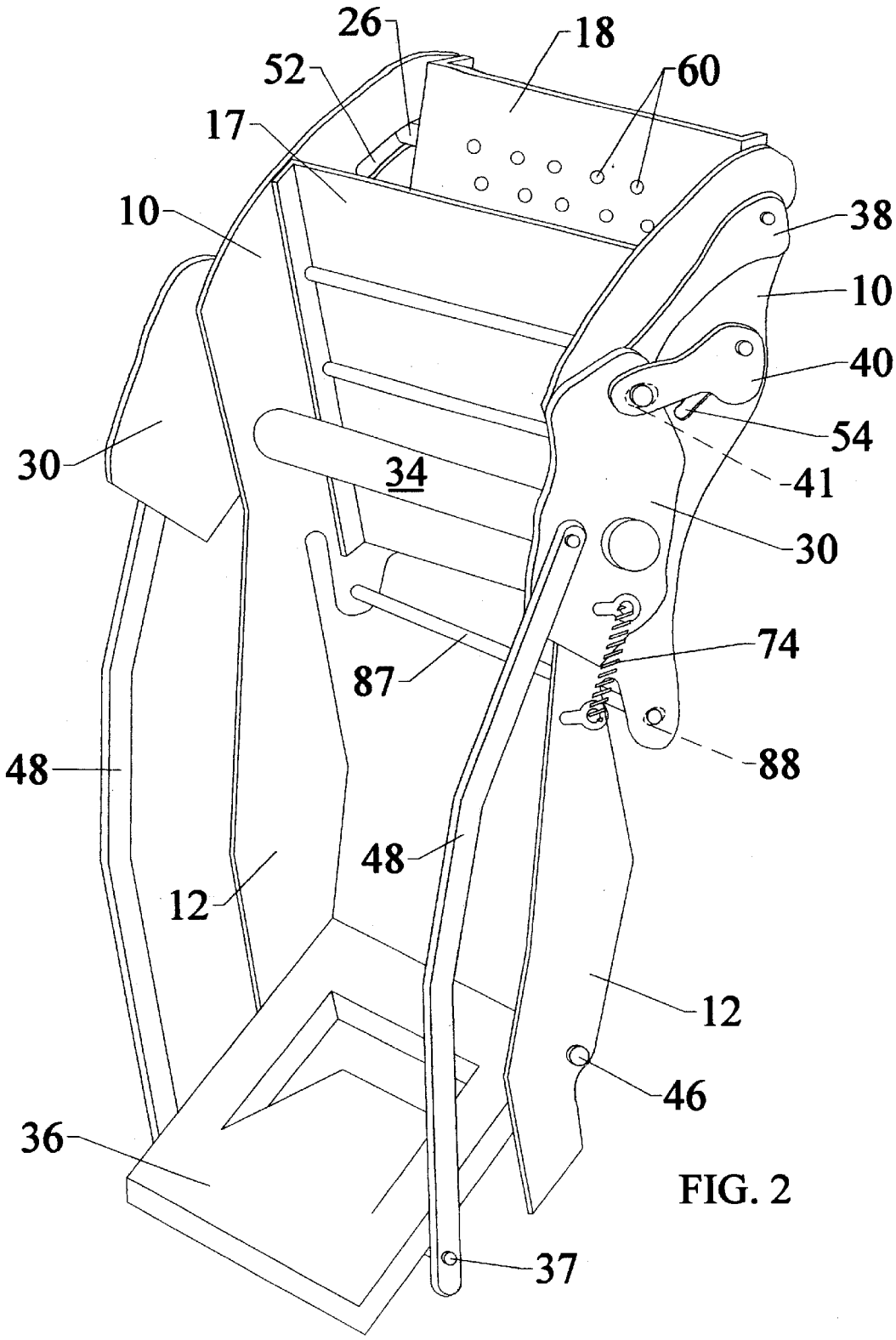
FIG. 2 shows a perspective view of the mop wringer as viewed from the front nearest the operator.
Figure 3:
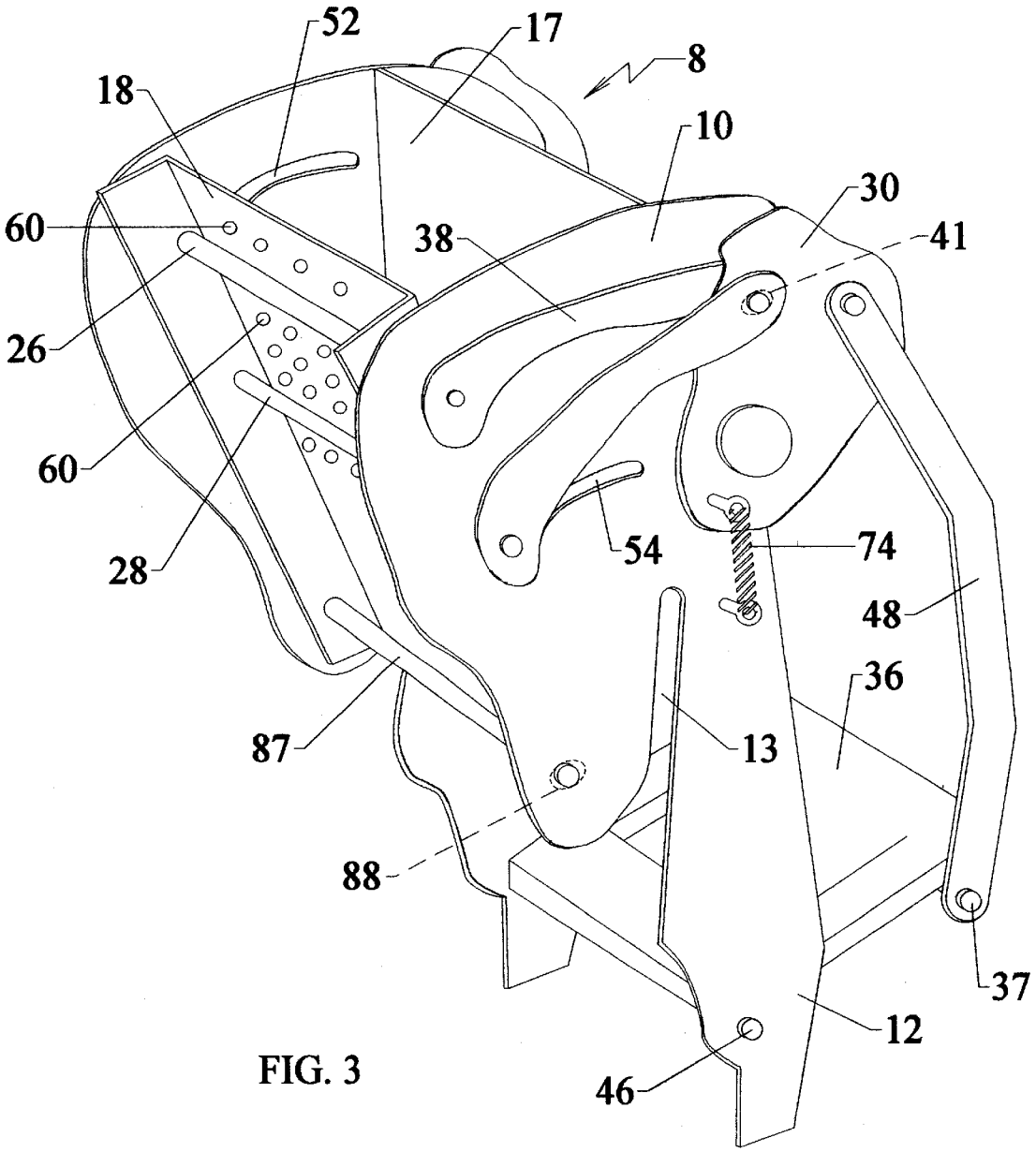
FIG. 3 shows a perspective view of the mop wringer as viewed from the opposite side as that of FIG. 2.
Figures 4, 5:
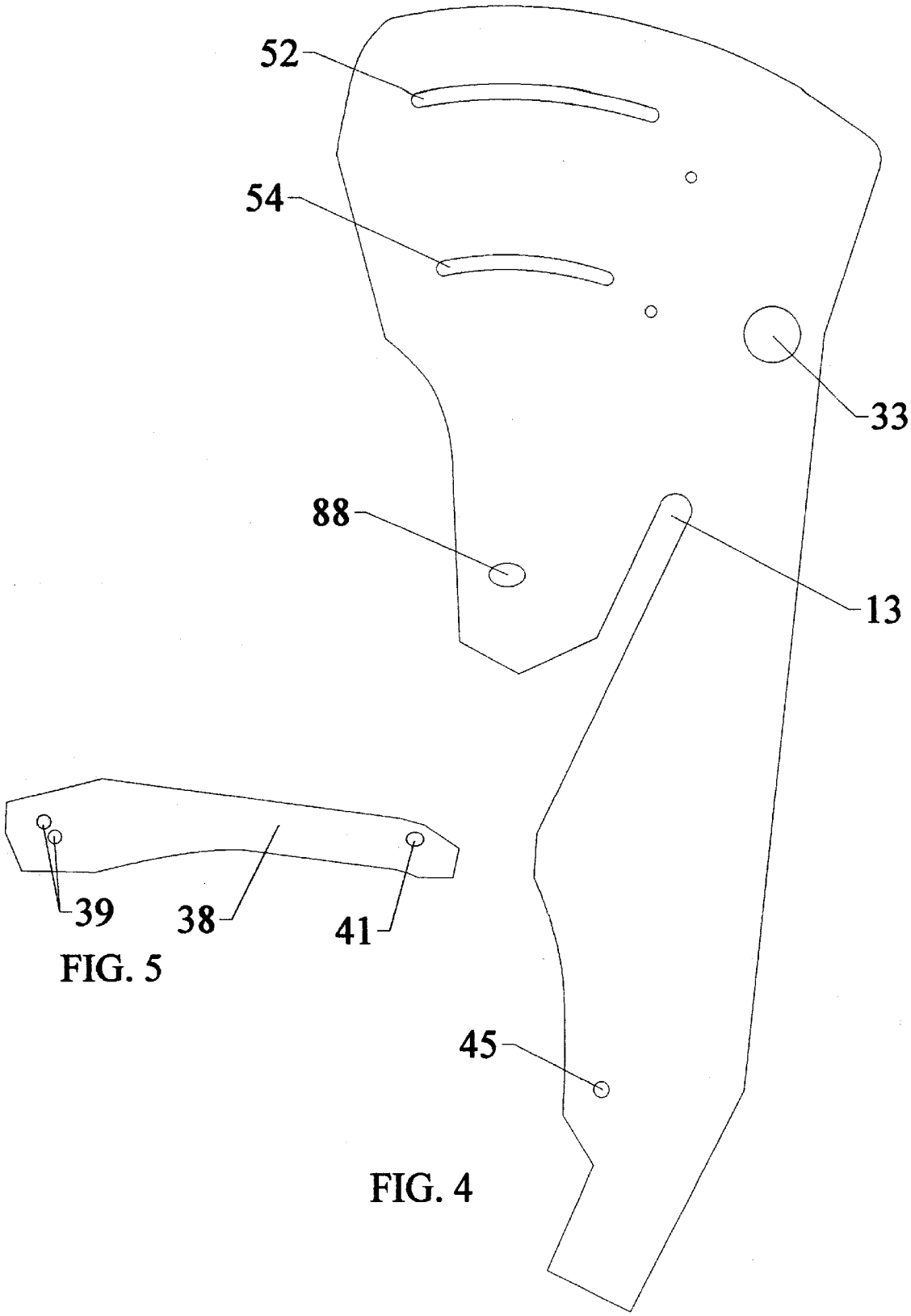
FIG. 4 shows the side view of a lateral plate with a downward extension defining a groove.
FIG. 5 shows a side view of a connecting arms 38 and 40.

The mop wringer, indicated generally by the numeral 8, is positioned on the rim of a mop bucket 9 or other suitable receptacle, as shown in FIG. 1. The wringer includes a pair of spaced frame members or lateral plates 10, each having a downwardly depending extension or leg 12, thereby defining a groove 13 to allow the wringer to rest on the rim of the bucket 9. The bottom marginal edge of each extension 12 terminates above the floor, thereby providing stability by pressing against the floor as the foot pedal is depressed during the wringing step.

The lateral plates 10 are provide with aligned openings 45 that accommodate and hold the lower-most axle 46 which spans the leg extensions 12 of the spaced lateral plates 10. Similarly, the upper axle 34 is passed through and held by aligned openings 33, and axle 34 spans the spaced lateral plates 10. Disk links 30 are mounted on the opposed ends of the upper axle 34 and to the outside of the lateral plates. It is understood by one skilled in the art that the axles, and cross bars described herein are secured at their ends by suitable caps, bolt heads, or the like.

A wringing basket, being disposed between the spaced, side lateral plates 10, includes a stationary squeeze plate 17 and a movable squeeze plate 18. Movable squeeze plate 18 forms the back wall of the wringing basket. Movable squeeze plate 18 is positioned so that it nearly makes contact with the stationary squeeze plate 17 of the wringing basket when the foot pedal is depressed and the wringing basket is closed. Movable squeeze plate 18 contains liquid evacuation apertures or slots 60. Movable squeeze plate upper cross bar 26 and lower cross bar 28, which span the back side of movable squeeze plate 18, propel and reinforce movable squeeze plate. The cross-bars 26 and 28 pass through arcuate slots 52 and 54, respectively, and are disposed perpendicularly to the lateral plates 10. Movable squeeze plate 18 pivots on the intermediate or middle axle 87, which is disposed perpendicular to and spans the spaced lateral plates 10. The middle axle penetrates both lateral plates through oversized openings 88. It should be understood that the reference to the intermediate or middle axle does not necessarily mean being disposed at a midpoint between the upper and lower axles.

Positioned on the outer side or surface of each lateral plate 10 are horizontal connecting arms 38 and 40, which have near one end at least one opening 39, preferably two such openings to allow for adjustment, and near the opposite end oversize opening 41. Further, the connecting arms 38 and 40 are connected at each end to cross bars 26 and 28, respectively, and at the opposite ends are overlapped, preferably one arm on each side of the disk, and are connected to the disk links 30 by passing a suitable bolt or the like through opening 41. Thus, the connecting arms, which are substantially horizontally disposed, are attached at one end to the disk links and at the opposite end to the lateral plates by cross bars 26 and 28, which span the space between the lateral plates. In order to provide for the proper action and to allow for articulation of the connecting arms during the wringing action, the cross bars 26 and 28 pass through arcuate slots 52 and 54, respectively, and the openings 88 in the lateral plates and openings 41 in the connecting arms 38 and 40 are oversized to allow for play in that these openings are substantially elliptical as viewed in a vertical plane so that the horizontal axis of each opening is substantially longer than the vertical axis and of the rod passing therethrough.

The outwardly disposed disk links 30 are attached to the foot pedal 36 by substantially vertical, lower connecting arms 48. Upper axle 34 spans perpendicularly through both of the lateral plates and through openings 33. The disk links 30 are mounted on suitable bushings that turn on an upper axle 34 so that the disk links pivot on this upper axle.

A return spring 74 is attached at one end to each outside disk link 30, and is anchored at the opposite end to the outside of each lateral plate 10. It will be observed that disk links 30 are located outside of the lateral plates. The lateral plates 10 have aligned arcuate slots 52 and 54, and upper cross bars 26 and 28 pass through the slots so that the upper cross bar 26 is connected to horizontal connecting arm 38 and the lower cross bar 28 to horizontal connecting arm 40. The disk link is connected to cross bar 26 by horizontal connecting arm 38 and to cross bar 28 by horizontal connecting arm 40. The disk links 30 are connected to the foot pedal 36 by outside lower connecting arms 48. Foot pedal 36 is connected to a bushing or the like that pivots on a lower axle 46 and is attached to the connecting arm 48 by cross arm 37 which provides support to the foot pedal. The lower axle perpendicularly spans through both lateral plates through lower axle openings 45. The movement and stabilization may be achieved by a suitable handle (not shown) as being attached to one of the lateral plates such as to the left side lateral plate.

Operation of Invention

A wet mop is positioned into the wringing basket from above. The head of the mop is placed between the movable squeeze plate 18, the lateral plates, and the stationary squeeze plate 17. The mop handle is positioned straight or nearly straight up.

A foot pedal 36 is depressed and pivots on the lower axle 46. The depression of the foot pedal 36 pulls on connecting arms 48 which exerts pull on disk link 30. Disk links 30 pivot on upper axle 34. Disk links 30 are connected to horizontal connecting arms 38 and 40 which are attached at the opposed ends of cross bars 26 and 28. Disk links 30) pull the connecting arms 38 and 40 that are attached to the cross bars 26 and 28. Thus, the horizontal connecting arms 38 and 40 pull on the cross bars as the disk links pivot on upper axle 34. The cross bars pull the movable squeeze plate 18 toward stationary squeeze plate 17, thereby providing a wringing action. Return springs 74 open the wringing basket when the foot pedal is released by pulling the disk links into their resting position.

Where desired, a movement and stabilization handle is held during the wringing operation. This handle assists stability of the bucket and wringer during wringing operation. The handle also is used to help move a wheeled bucket about the floor surface being mopped.

Figure 6:
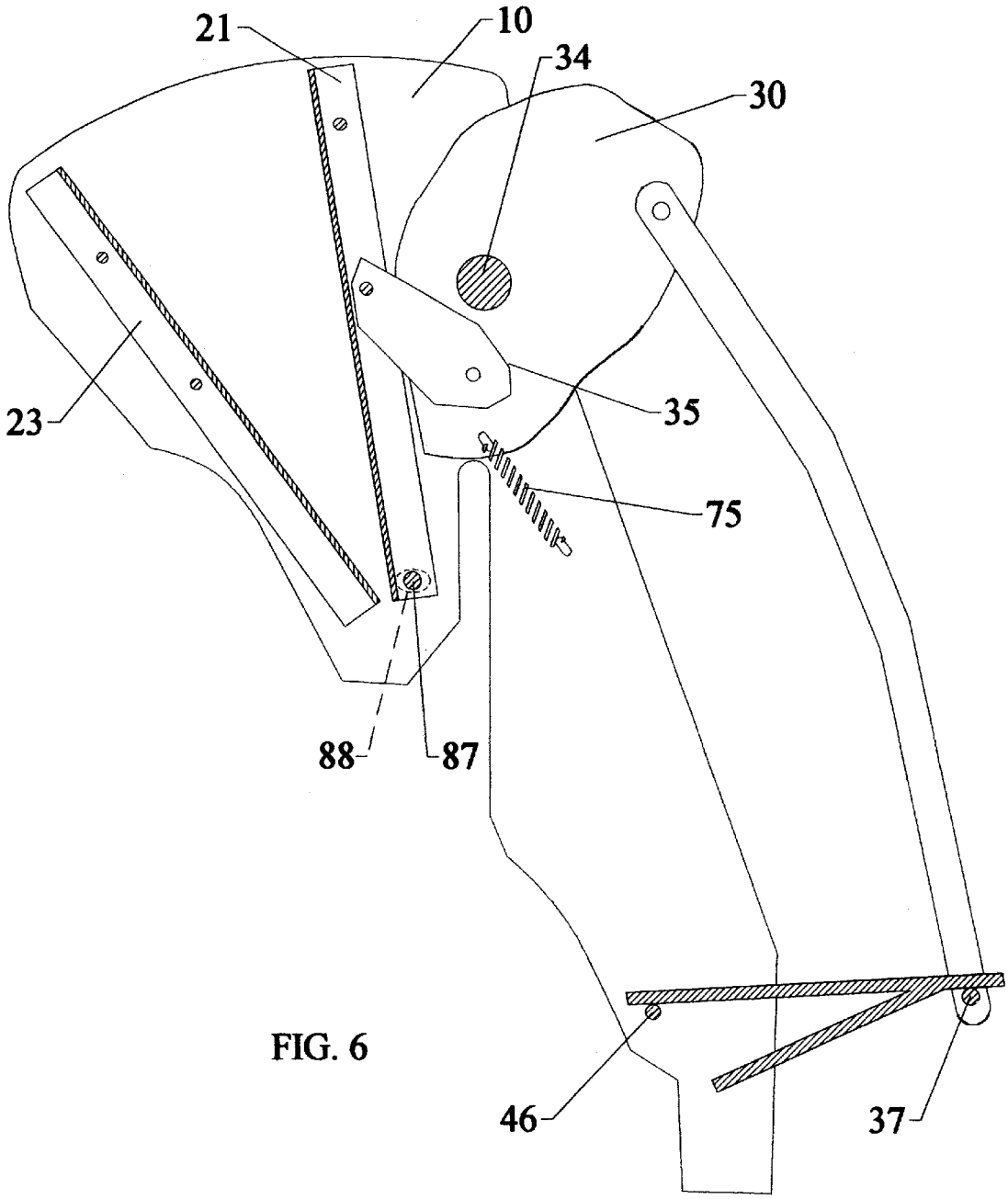
FIG. 6 shows in elevational cross-section view of an alternative embodiment of the invention.

In accordance with the modification shown in FIG. 6, movable squeeze plate 21 is pivoted when the foot pedal is actuated. Movable squeeze plate 21 pivots on the intermediate or middle axle 87. The middle axle penetrates both lateral plates through openings 88. Connecting arms 35 are connected at one end to the movable plate 21 and at the opposite ends to the disk links 30.

A return spring 75 is attached at one end to each disk link 30, and is anchored at the opposite end to the lateral plates 10. It will be observed that disk links 30 are located inside of the lateral plates.

When wringing the mop, the foot pedal is depressed, the disk links 30 are pivoted on axle 34, and the connecting arms 35 push the movable plate 21 toward the stationary plate 23, thereby providing a wringing action. Return springs 75 open the wringing basket when the foot pedal is released by pulling the disk links into their resting position.

By reason of the invention, numerous advantages are achieved. In addition, it should be understood that the foregoing detailed description has been given for clearness of understanding only, and no unnecessary limitations should be understood therefrom, as modifications will be obvious to those skilled in the art.

What is claimed is:

1. A mop wringer comprising:

a) a pair of frame members defining a space therebetween and including means for attaching to a receptacle, the frame members each including a lower leg member;

b) a stationary squeeze plate and a movable squeeze plate located in the space between the frame members and between which the mop may be placed for wringing, the movable squeeze plate having a lower portion pivoting about a middle axle extending between the frame members;

c) a foot pedal pivotally connected to the lower leg members about a lower axle;

d) an upper axle extending through and between the frame members;

e) an outside disk mounted about the upper axle on an outer side on each of the frame members, each outside disk connected to an upper portion of the movable squeeze plate by at least one connecting arm;

f) first and second vertical connecting arms interconnecting the foot pedal to the outside disks;

g) a spring connected between the disks and the adjacent frame member;

h) whereby, when the user depresses the foot pedal the movable squeeze plate is pivoted toward the stationary squeeze plate and when the user removes their foot from the foot pedal the movable squeeze plate is biased to a rest position by the spring.

2. A mop wringer comprising:

a) a pair of spaced, substantially parallel frame members each having a downwardly depending leg member, and including attaching means for seating the wringer on the rim of a receptacle;

b) a first axle extending between said frame members;

c) a stationary squeeze plate and a movable squeeze plate located in the space between the frame members and between which the mop may be placed for wringing, said movable squeeze plate pivoting about said first axle;

d) a second axle extending between said leg members;

e) a foot pedal pivotally connected to the lower leg members about said second axle;

f) a third axle extending through and between said frame members above said first axle;

g) a pair of disks mounted near opposed ends of said third axle adjacent each of said frame members;

h) at least one connecting arm operatively connected to an upper portion of the movable squeeze plate and near the opposite ends to said disks;

i) substantially vertical connecting arms operatively interconnecting the foot pedal to said disks;

j) bias means connected to said disks and an adjacent frame member;

k) whereby, when the foot pedal is actuated, said movable squeeze plate is pivoted toward the stationary squeeze plate, and when deactuated, said movable squeeze plate is biased to a rest position.

3. A mop wringer according to claim 2 wherein there is included a pair of connecting arms, and each frame member having spaced arcuate slots each adaptable for receiving a rod disposed on the back side of said movable squeeze plate for attachment to said connecting arms.

4. A mop wringer according to claim 2 wherein said frame members include aligned openings adaptable for receiving said second and third axles, said aligned openings being of larger dimensions than said axle.

* * * * *